US005678281A

United States Patent [19]

Kamp et al.

[11] Patent Number: 5,678,281

[45] Date of Patent: Oct. 21, 1997

[54] CLIP ASSEMBLY

[75] Inventors: Oscar Laurentius Jozef Kamp, Arnhem, Netherlands; Thomas Waldner, Malmö, Sweden

[73] Assignee: Telefonaktiebolaget LM Ericsson, Stockholm, Sweden

[21] Appl. No.: 542,024

[22] Filed: Oct. 12, 1995

[30] Foreign Application Priority Data

Oct. 18, 1994 [EP] European Pat. Off. ..... 94203019

[51] Int. Cl.[6] ..... A45F 5/02

[52] U.S. Cl. ..... 24/3.11; 24/511

[58] Field of Search ..... 224/669, 269; 24/511, 499, 3.11, 3.12, 3.1, 507, 508

[56] References Cited

U.S. PATENT DOCUMENTS

| | | | |
|---|---|---|---|
| 650,251 | 5/1900 | Humphrey | 24/511 |
| 3,710,423 | 1/1973 | Zimpleman . | |
| 4,536,925 | 8/1985 | Boothe et al. . | |
| 4,780,934 | 11/1988 | Vickers et al. . | |
| 5,016,326 | 5/1991 | Goldenberg . | |
| 5,301,393 | 4/1994 | Brown | 24/511 X |
| 5,379,490 | 1/1995 | Wandt et al. | 24/3.11 |
| 5,385,282 | 1/1995 | Chen | 24/3.11 X |

FOREIGN PATENT DOCUMENTS

| | | |
|---|---|---|
| 552 962 | 7/1993 | European Pat. Off. . |
| 2 150 202 | 6/1985 | United Kingdom . |

OTHER PUBLICATIONS

H.B. Chan et al., "Pager Belt Clip," Motorola Technical Developments, vol. 12 (Apr. 1991).

*Primary Examiner*—James R. Brittain

*Attorney, Agent, or Firm*—Burns, Doane, Swecker & Mathis, L.L.P.

[57] ABSTRACT

A clip assembly for attachment to a body or housing, in particular a portable electronic apparatus, includes an elongated clip member and a leaf spring member for biasing the clip member toward the body or housing. The leaf spring member extends in a longitudinal direction of the clip member, and is attached at a first end to the clip member at a position between a first and second end of the clip member. A second end of the leaf spring member extends in the direction of the second end of the clip member to contact and exert pressure against the body or housing. The clip member is easy to assemble and can be releasably attached to the body or housing by snap fittings or similar devices.

8 Claims, 2 Drawing Sheets

CLIP ASSEMBLY

FIELD OF THE INVENTION

The present invention relates to a clip assembly for use with a portable electric or electronic apparatus, in particular a portable electronic telecommunication device such as a portable cordless or mobile telephone, a radio pager and the like.

BACKGROUND OF THE INVENTION

Clip assemblies of the type according to the present invention comprise a clip member or a clip hook which is resiliently biased towards the body or housing of a device to which the clip assembly is attached. By lifting the clip member against its biasing force, an object such as a piece of garment, a pocket, or a belt can be received between the clip member and the body or housing of the device. After release of the clip member, due to the biasing force acting on the clip member, the device and the object are mutually firmly clamped. The clip assembly can be either directly connected to the body or housing of the device or by a separate attachment member Or mounting bracket.

U.S. Pat. No. 3,710,423 discloses a clamping device for clamping an article to a perforated board. In use, the biasing means are secured to the board by a separate mounting bracket.

Prior clip assemblies, such as disclosed by EP-A-0,552,962; U.S. Pat. Nos. 4,780,934 and 4,536,925 generally comprise a support structure having a hinge shaft, a separate attachment member or mounting bracket to which the clip assembly is fixedly mounted, fastening lugs on the clip member and the attachment member for supporting the shaft, and biasing means formed by small torsion springs or small leaf springs. The biasing springs act on the clip member at or near the hinge point thereof.

The support and biasing structure of these known clip assemblies is structurally rather complicated, comprising a number of small parts, which are not only difficult to assemble but are also prone to damage. In particular, if an external force is exerted on the clip member, for example when the portable strikes upon a table or the like or when the portable hooks behind an arm of a chair or another object and is forcefully removed, besides breakage of a lug or lugs the clip assemblies can fall to pieces and are then difficult to reassemble.

U.S. Pat. No. 5,016,326 discloses a clip assembly comprising a clip member or a clip hook and biasing leaf spring means. One end of the clip member is pivotally mounted at the body or housing of a device, such that an opposite receiving end of the clip member can be raised from the body or housing of the device for the receipt of a piece of garment or another object. One end of the leaf spring means engages the clip member at its pivot point whereas an opposite end of the leaf spring means extends in the direction of the receiving end of the clip member and is supported by the body or housing of the device.

The receiving opening of this known device is, however, limited to such part of the receiving end of the clip member which, if viewed from its pivot point, projects beyond the support point of the leaf spring means at the body or housing of the device.

SUMMARY OF THE INVENTION

A first object of the invention is to provide a clip assembly of the type having a pivotable clip member or clip hook and biasing means, which clip assembly is compact in size and relatively easy to assemble with as little as possible small and/or separate parts, and without the need for a separate support of the biasing means at the body or housing to which the clip assembly is attached.

It is a second object of the invention to provide a clip assembly which can be easily attached to a device without having to exercise special technical skills.

It is a third object of the invention to provide a clip assembly which, as a safety measure, automatically releases from the body or housing to which it is attached in case a detachment force exceeding a certain threshold is exerted on the clip member.

According to the invention, there is provided a clip assembly for attachment to a body or housing, comprising an elongated clip member having a first end and a second end, hinge means arranged between the first end and second end for pivotally mounting the clip member, and leaf spring means extending in longitudinal direction of the clip member for biasing the first end of the clip member towards the body or housing. A first end of the leaf spring means engages the clip member at a position between the first end and the second end thereof, whereas a second end of the leaf spring means extends in the direction of the second end of the clip member. The leaf spring means has a spring force such that in its assembled state the second end of the leaf spring means is urged towards the body or housing.

The clip assembly according to the invention, with its longitudinally extending leaf spring means, combines a small size with a high biasing force, i.e. clamping or holding force, which is an important advantage in view of the trend towards smaller sizes for portable telecommunication devices and the like.

With the clip assembly of the invention the leaf spring means, with their second end, may freely extend in the direction of the second end of the clip member, such that there is no need for a separate support of the leaf spring means at the body or housing of the device to which the clip assembly is to be attached.

The clip assembly of the invention comprises a common single mounting point, i.e. its hinge means for pivotally mounting the clip assembly to a body or housing of a device, such that attachment of the clip assembly can be established without having to use a separate attachment member, mounting bracket etc.

In the arrangement according to the invention, in order to provide for a releasable attachment, the hinge means are advantageously configured for releasable attachment by snap fitting on the body or housing. Suitable snap fittings are known per se in practice.

By a proper design of the snap fitting, as a safety measure, automatic release of the attachment of the clip assembly can be obtained in those cases, for example, when the portable strikes upon a table or the like or when the portable hooks behind an arm of a chair or another object causing a forceful detachment of the clip assembly. With such a measure damage of the clip assembly and/or the hinge means and the body or housing of a device can be effectively avoided. By having the leaf spring means attached to the clip member, the connection can be easily restored by snapping the clip assembly and the body or housing together.

By shaping the clip member such that the leaf spring means, from the first end of the clip member, extends for the greater part within the circumference of the clip member, an object projecting a certain distance beyond the first end of the clip member in the direction of the second end of the clip member can be received between the clip member and the body or housing of a device without impeding the biasing force of the leaf spring means. Accordingly, a relatively large receiving opening is provided for the receipt of an object.

The term leaf spring means used in the present description and the claims is to be construed as comprising any resilient means having a spring action comparable to a leaf spring.

In an embodiment of the invention the leaf spring means comprise at least one single leaf spring, the first end of which is attached the clip member at or near the first end thereof. With such a Separate leaf spring, by properly selecting its spring characteristics, the biasing of the clip member can be relatively accurately set to meet the conditions required. The leaf spring can be made of a plastic material or a metal.

In a preferred embodiment of the invention, the leaf spring is attached to the clip member by means of a separate grip piece provided at the first end of the clip member, for frictionally holding the clip to a piece of a garment or the like.

In a yet further embodiment for mounting the grip piece, the clip member is provided, at its outwardly facing surface, with a recess which connects to an opening for receiving the grip piece. The grip piece has a first part which closes off the recess and a second part which, through the opening, extends from the clip member in the direction of the body or housing. This second part of the grip piece has a slit for receiving the first end of the leaf spring, such that in its assembled state the first end of the leaf spring is positioned and held in the recess by means of the grip piece.

This construction is very simple and avoids the need for separate joint means such as screws, rivets or the like, for connecting the leaf spring to the clip member. By using the clip piece, which is preferably made of rubber, an easy to assemble and to reassemble clip assembly is provided. For locking the leaf spring in the recess of the clip member, in another embodiment of the invention, the recess and the leaf spring are provided with complementary connecting projections and cut outs. The projections are preferably formed in the recess and are inclined towards the first end of the clip member, in order to provide a self latching effect of the leaf spring and the clip member during and after their assembly.

In a still further embodiment of the invention the leaf spring means are integrally formed with the clip member and may comprise a pair of lip shaped leaf springs positioned at each side of the clip member. Advantageously, the lips can be made out of the plane of the clip member, for example in the form of a single loop shaped configuration which extends from part of the circumference of the clip member. It is, however, also possible to use separate lip shaped leaf spring means which are completely or partly embedded in or covered by the material of the clip member.

Such an integral embodiment of the clip member and the leaf spring means is preferred from an assembling point of view. By having also the hinge means integrally formed with the clip member, the clip assembly is just comprised of one single piece.

Although the clip assembly according to the invention is designed for use without a separate attachment member, it will be understood that whenever a separate attachment member is preferred or needed, e.g. in case of replacement of a prior art clip assembly by the clip assembly of the invention, the latter can be provided mounted at such attachment member. This while maintaining all the other features and advantages as mentioned above.

The invention relates also to a portable electronic apparatus, in particular a portable electronic telecommunication device such as a cordless or mobile telephone or radio pager, comprising the novel and inventive clip assembly as described above.

DETAILED DESCRIPTION OF EMBODIMENTS

The invention will now be described and illustrated with reference to exemplary embodiments to which the invention is, however, not limited. It will be understood that the invention is neither limited to its use with portable electric or electronic apparatuses such as a cordless or mobile portable telephone.

Figure 1:
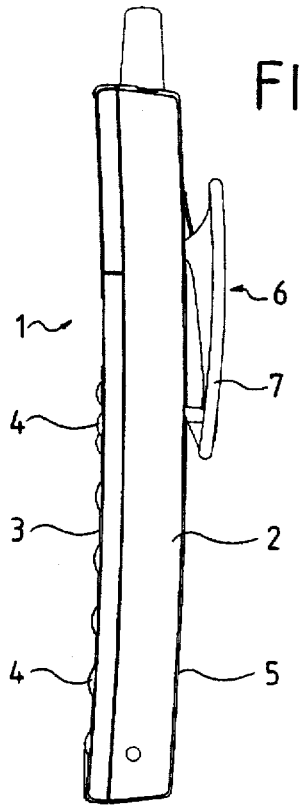
FIG. 1 is a schematic side view illustrating a cordless portable telephone provided with a clip assembly according to the invention.

FIG. 1 shows in a side view a cordless or mobile portable telephone 1, having a plastic body or housing 2 with a front face 3, provided with several push buttons 4 for operating the telephone, and a back or rear face 5, to which a clip assembly 6 according to the present invention is attached. The clip assembly 6 comprises an elongated plastic clip member or clip hook 7 which is pivotally connected to the rear face 5 of the body or housing 2.

Figure 2:
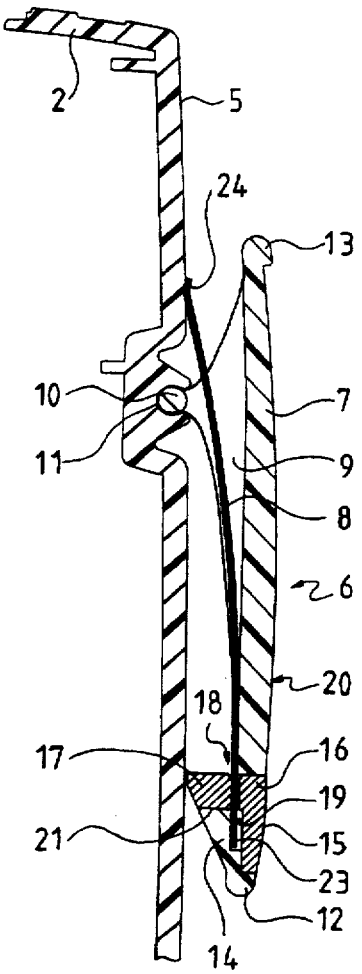
FIGS. 2 and 3 are schematic cross sections on an enlarged scale through part of the portable telephone shown in FIG. 1, illustrating the clip assembly in different positions.

FIG. 2 shows, on an enlarged scale, part of the clip assembly 6 and the body or housing 2 of FIG. 1. Besides the clip member 7, the clip assembly comprises biasing means in the form of a leaf spring 8 and hinge means in the form of a support section 9 which is formed as an integral part of the clip member 7. The support section 9 has a protruding shaft like attachment part 10 which is configured for pivotally releasable snap insertion into a complementary recess 11 of the body or housing 2. As illustrated, the support section 9 is positioned between a first end 12 and a second end 13 of the clip member 7, such that the hinge point formed by the attachment part 10 is closer to the second end 13.

At its first end 12, the clip member 7 terminates in a barb-like projection 14. At its first end 12 the clip member 7 is also provided with a grip piece 15 of rubber or the like. A part 16 of this grip piece 15 is received in a recess 19 formed in the outwardly facing surface 20 of the clip member 7, whereas another part 17 of the grip piece 15, making right angles with the part 16, is received in a through opening 21 which connects to the recess 19 adjacent the projection 14, viewed in the direction of the second end 13 of the clip member 7. The part 17 of the grip piece 15 is dimensioned such that, when assembled, this part 17 projects from the clip member 7 to form with the projection 14 an integral barb shaped end of the clip member 7.

The biasing leaf spring 8, which can be of plastic or a suitable metal such as stainless steel, has a first end 23 which is attached to the clip member 7 at its first end 12, and a second end 24 which extends freely in the direction of the second end 13 of the clip member 7 beyond the hinge point thereof. At its first end 23 the leaf spring 8 is received in the recess 19 through a slit or slot 18 in the part 17 of the grip piece 15. The leaf spring 8 has a spring force or tension which urges the clip member 7 with its first end 12 towards the rear face 5 of the body or housing 2 until it is stopped by the grip piece 15 making contact with the rear face 5, and urges the second end 24 of the leaf spring 8 towards and against the rear face 5 of the body or housing 2, as shown.

Figure 3:
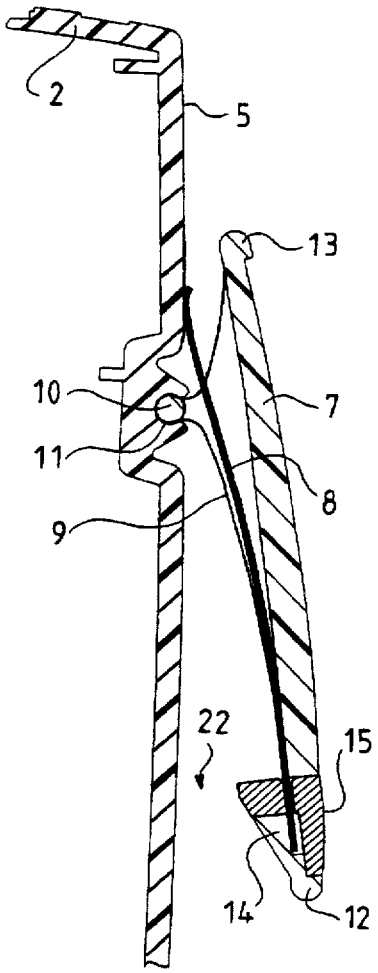

FIG. 3 shows the clip member 7 in a lifted position, such that there is formed a receiving opening 22 between the rear face 5 and the grip piece 15, i.e. the first end 12 of the clip member 7, for receiving a piece of garment or a belt or the like, not shown. The clip member 7 can be lifted either by pushing its second end 13 towards the rear face 5 of the body or housing or by raising the first receiving end 12 of the clip member 7 with respect to the rear face 5 of the body or housing 2.

By removing such a lifting force, the clip member 7, under the biasing force of the leaf spring 8, returns to the position shown in FIG. 2. In cases where there is inserted an object such as a piece of garment between the grip piece 15 and the rear side 5 of the body or housing 2, the piece of garment is clamped to the body or housing 2 by the clip member 7, i.e. its grip piece 15. The clamping strength depends mainly on the spring characteristics of the leaf spring 8, its dimensions and the positions at which the leaf spring engages the clip member 7 and the body or housing 2. The grip piece 15 of rubber provides an additional frictional force to the piece of garment.

From FIGS. 2 and 3 it can be seen that the support section 9 is shaped such that the leaf spring 8 from its first end 23 extends for the greater part within the circumference of the clip member 7. Accordingly, an object received in the receiving opening 22 will not impede or otherwise have an influence on or is obstructed by the leaf spring 8.

By spacing apart the positions at which the leaf spring 8 engages the clip member 7 and the body or housing 2, respectively, the mechanical force exerted on the clip member 7 is properly distributed along the length thereof. Further, in the arrangement of the invention, the clip member 7 is biased for the greater part by the relatively high spring force of the leaf spring 8 acting in longitudinal direction thereof. This means that with a relatively small sized clip assembly 6 according to the invention, a relatively high clamping or holding force can be provided. The clamping force of the clip assembly can be further controlled by limiting the travel of the second free end 24 of the leaf spring 8, for example by providing at the rear side or back 5 of the body or housing 2 a groove in which the second end 24 is received and/or can slide (not shown).

Figure 4:
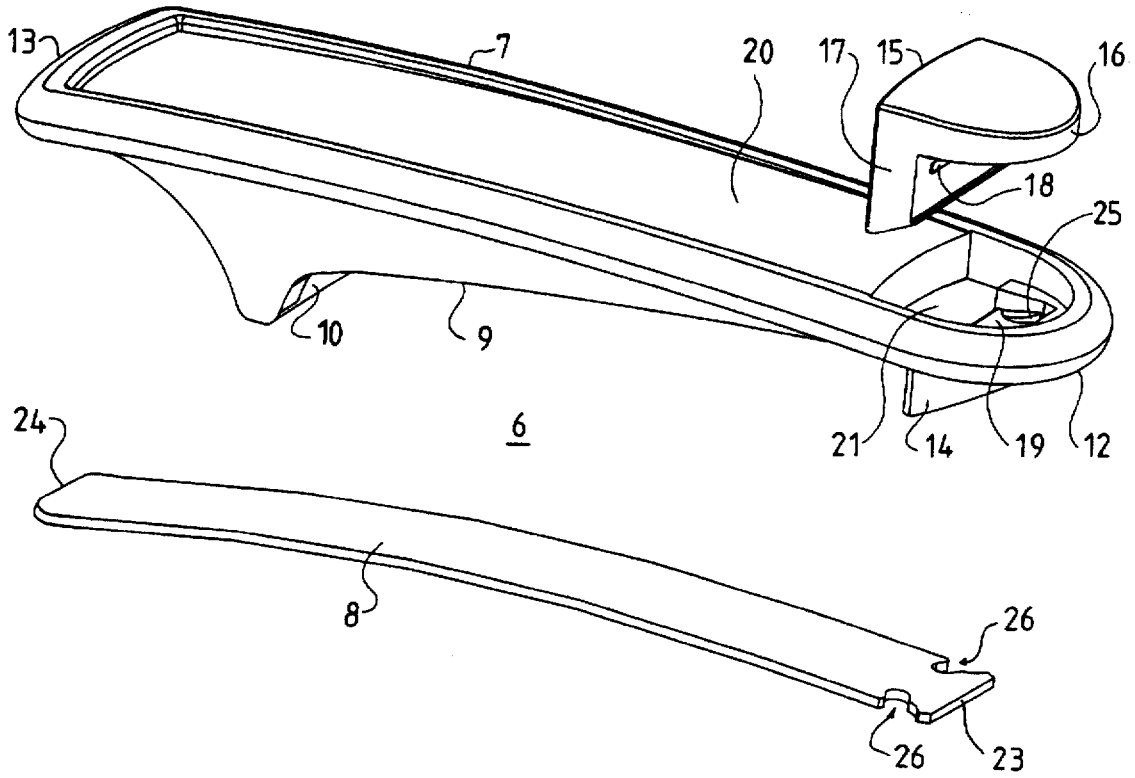
FIG. 4 is a schematic perspective exploded view of the clip assembly shown in FIGS. 2 and 3, illustrating the several parts of the clip assembly before assembly thereof.

FIG. 4 shows the several parts of the clip assembly 6 in their disassembled form. The recess 19 in the clip member 7 is provided with two semi-circular projections 25, of which only one is shown. These projections are raised in the direction of the first end 12 and towards the outwardly facing side 20 of the clip member 7. The leaf spring 8 is at its first end 23 provided with complementary semi-circular like cut outs 26, as shown.

The clip assembly 6 can be very easily assembled by pushing the grip piece 15 into the recess 19 of the clip member 7, as shown, while simultaneously inserting the leaf spring 8 with its first end 23 through the slot 18 of the grip piece 15 into the recess 19. The corresponding semi-circular protrusions and cut outs 25, 26 will snap into each other in a self-aligning manner. In the assembled state, the grip piece 15 and the leaf spring 8 hold each other in position without the need for additional fixing means such as screws, rivets or the like. It will be understood that by the absence of small parts, the clip assembly is very easily to assemble and to reassemble in case it has been fallen to pieces, without a need for special tools or skills. Further, the clip member and leaf spring can be kept in stock as spare parts.

The opening 21 is also very advantageously from a moulding point of view. In order to provide for multiple protrusions at on side of a body or housing, such as the attachment part 10 and the barb-like projection 14 of the clip member 7, the mould has to be provided with a relatively complicated structure of mould slide means. However, with the clip member 7 of the invention, the projection 14 at the first end 12 can be formed in one step with the opening 21, such that a relatively simple single mould slide structure for forming the attachment part 10 suffices.

Figure 5:
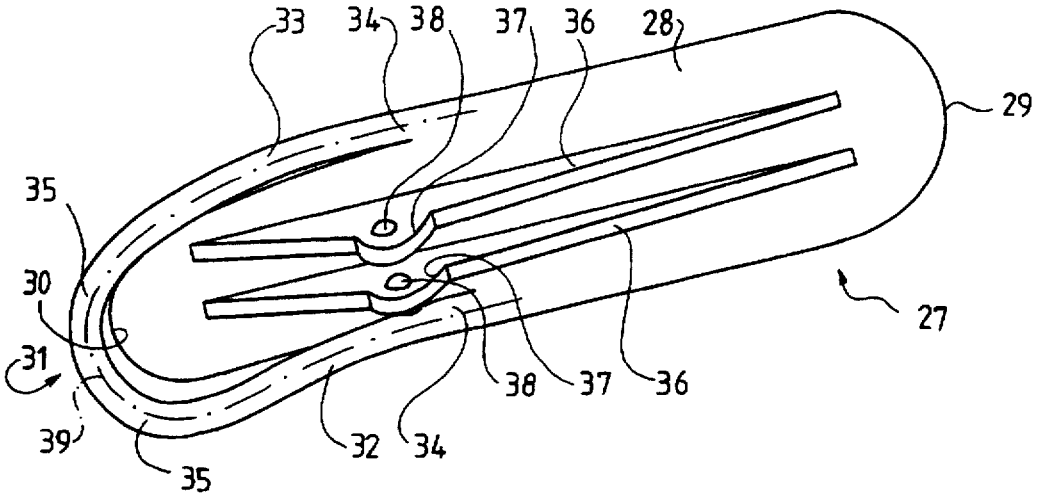
FIG. 5 is a schematic perspective view of the clip assembly according the invention, illustrating a clip member and leaf spring means integrally formed with the clip member.

FIG. 5 illustrates a further embodiment of a clip assembly 27 based on the concept of the invention. There is shown a elongated plastic clip member 28, having a first end 29 and a second end 30 and leaf spring means 31. The leaf spring means 31 take the form of two lip shaped leaf springs 32, 33 each positioned at a longitudinal edge of the clip member 28. With their first ends 34 the leaf springs 32, 33 are connected to the clip member 28 between the first end 29 and the second end 30 thereof, whereas the second ends 35 of the leaf springs 32, 33 are mutually connected to form a single loop shaped configuration which extends in the direction of the second end 30 of the clip member 28.

The clip member comprises hinge means in the form of two parallel support sections 36 which are formed as an integral part of the clip member 28. The support sections 36 have protruding attachment parts 37, each comprising oppositely directed semi-spherical protrusions 38 which are configured for pivotally releasable snap insertion in complementary recesses provided in the body or housing to which the clip member is to be attached, or in a separate attachment member, not shown.

In the embodiment shown in FIG. 5, the loop shaped spring means 31 and the support sections 36 are formed in one piece from the material of the clip member 28. As indicated by a dot/dashed line 39 it is also possible to have separate leaf spring means embedded in or covered by the plastic of the clip member 28. It will be understood that this is a very attractive embodiment, because the clip assembly as a whole comprises essentially one single part.

A skilled person will understood that the support or hinge sections 9, 36 of the clip assemblies 6, 27 can be mutually substituted or replaced by other known support sections. It is of course not mandatory to use releasable support means, in particular the snap fittings shown. The clip assembly is further not restricted to the use of plastic material or the connection of the leaf spring 8 to the clip member 7 by means of the grip piece 15. Such connection can also be made by means of screws, rivets and the like or by embedding the first end 23 of the leaf spring 8 in the clip member 7.

We claim:

1. A clip assembly for attachment to a body or housing, comprising an elongated clip member having a first end and a second end, hinge means arranged between said first end and second end for pivotally mounting the clip member to the body or housing, and leaf spring means extending in longitudinal direction of the clip member for biasing the first end of the clip member toward the body or housing, said leaf spring means having an elongated curved shape, and being disposed with a convex side facing the member, and wherein a first end of the leaf spring means engages the clip member proximal the first end of the clip member and is substantially parallel thereto, and a second end of the leaf spring means extends freely in the direction of the second end of the clip member, said leaf spring means having a spring force so that when attached to a body or housing said second end of the leaf spring means is urged toward said body or housing.

2. A clip assembly according to claim 1, wherein the clip member at the first end is provided with a grip piece for holding the clip member to an object, said leaf spring means being attached to said grip piece.

3. A clip assembly according to claim 2, wherein the clip member, at an outwardly facing surface, is provided with a recess which connects to an opening for receiving said grip piece, said grip piece having a first part which closes off said recess and a second part which projects through said opening from the clip member in the direction of the body or housing, wherein said second part of said grip piece has a slit for receiving said first end of said leaf spring means, so that said first end of said leaf spring means is latched in said recess by said grip piece.

4. A clip assembly according to claim 3, wherein said recess is provided with projections which connect to complementary cut outs of said leaf spring means, said projections are inclined towards the first end of the clip member, in order to provide a latching effect of said leaf spring means and clip member.

5. A clip assembly according to claim 1, wherein said hinge means is configured for releasable attachment by snap fitting means.

6. A clip assembly according to claim 1, wherein the hinge means includes elongated support flanges that define an elongate channel extending from the hinge means to proximate the first end of the clip member, wherein the a portion of leaf spring means extending from the first end of the clip member to the hinge means is substantially disposed within the channel.

7. A portable electronic apparatus, in particular a portable electronic telecommunication device having a body or housing with a wall and a clip assembly, said clip assembly comprising an elongated clip member having a first end and a second end, hinge means arranged between said first end and second end for pivotally mounting the clip member to said wall, and leaf spring means having an elongated curvature from a first end to a second end and extending in longitudinal direction of the clip member for biasing the first end of the clip member toward the wall, wherein the first end of the leaf spring means is attached to the clip member at a position between the first end and the second end thereof, and a second end of the leaf spring means extends in the direction of the second end of the clip member, a convex side of the leaf spring means facing the clip member, said leaf spring means having a spring force so that said second end of the leaf spring means is urged toward said wall.

8. A clip assembly for attachment to a body or housing, comprising an elongated clip member having a first end and a second end, hinge means arranged between said first end and second end for pivotally mounting the clip member, and leaf spring means extending in longitudinal direction of the clip member for biasing the first end of the clip member towards the body or housing, wherein the leaf spring means comprise a pair of leaf springs positioned at each side of the clip member and at least partly embedded in the clip member, said leaf springs having the shape of elongates lips, wherein a first end of each leaf spring is attached to the clip member at a position between the first end and the second end thereof, and a second end of the leaf spring means extends in the direction of the second end of the clip member, and wherein said leaf springs at their second ends connect to each other to form a looped shaped configuration which extends along a circumference of the second end of the clip member, said leaf spring means having a spring force such that when attached to a body or housing said second end of the leaf spring means is urged towards said body or housing.

* * * * *